United States Patent [19]

Stark

[11] Patent Number: 4,903,946

[45] Date of Patent: Feb. 27, 1990

[54] LIFTING DEVICES FOR CONTAINERS

[76] Inventor: Crister Stark, Johannesberg, Axtavägen, S-596 00 Skänninge, Sweden

[21] Appl. No.: 225,753

[22] PCT Filed: Nov. 20, 1987

[86] PCT No.: PCT/SE87/00548

§ 371 Date: Jul. 29, 1988

§ 102(e) Date: Jul. 29, 1988

[87] PCT Pub. No.: WO88/04276

PCT Pub. Date: Jun. 16, 1988

[30] Foreign Application Priority Data

Dec. 1, 1986 [SE] Sweden ..... 8605150

[51] Int. Cl.[4] ..... B66F 7/26

[52] U.S. Cl. ..... 254/45

[58] Field of Search ..... 254/45, 47, 89 H; 414/495, 498

[56] References Cited

U.S. PATENT DOCUMENTS

| | | | |
|---|---|---|---|
| 3,541,598 | 11/1970 | Dousset | 254/45 |
| 3,749,363 | 7/1973 | Hauser | 254/45 |
| 3,830,466 | 8/1974 | Rasmussen et al. | 254/47 |
| 3,986,702 | 10/1976 | Barber | 254/45 |
| 4,045,000 | 8/1977 | Mai | 254/45 |
| 4,053,073 | 10/1977 | Franchin | 254/89 H |
| 4,765,594 | 8/1988 | Riedl et al. | 254/45 |

*Primary Examiner*—Robert C. Watson

*Attorney, Agent, or Firm*—Sughrue, Mion, Zinn, Macpeak & Seas

[57] ABSTRACT

A lifting system for a container includes four lifting columns each removably connected to one of four vertical corner edges of the container. Each lifting column is telescopable with the aid of power means driven by a power source via a control system. The lifting columns are in pairs forming two separate lifting aggregates placed at opposite sides of the container. Each lifting aggregate is connected in a closed loop circulation circuit including connecting piping from respective controls to the first lifting column, a first interconnection from the first lifting column to the second column and a second interconnection from the second lifting column back to the control. The first closed loop at one side of the container is completely separate from the second closed loop at the other side of the container and in effect synchronous, equal displacement of the lifting column for each separate lifting aggregate.

9 Claims, 6 Drawing Sheets

LIFTING DEVICES FOR CONTAINERS

The present invention relates to a portable and easily transportable device for substantially vertical movement of a container, preferably movement between the ground and the load deck of a vehicle. During transport the four lower corners with their corner boxes arranged on the containers are removably connected to fastener means arranged on the load vehicle, these means engaging in bottom holes in the lower corner boxes.

Lifting devices for containers are known in the form of separate devices or lifting columns which are attached to the four corners of the container using the upper and lower corner boxes and their openings The lifting devices are removably coupled to the side openings in the upper and lower boxes of the respective corner. Such devices are individually driven, either manually or with the aid of drive units, often of the hydraulic type, arranged on each device.

A known device of this kind is described in the German Patent Application No. P 31 38 443.

The known devices are troublesome to use particularly in primitive conditions, e.g. use out in the open or in terrain, in loading or unloading containers at optional places, possibly without the availability of an outside power source, such as electricity or the like.

The different lifting devices in known lifting arrangements are also often heavy and require the availability of different aids for handling them. Similarly, there is generally required the cooperation of several persons for fitting and removing the lifting apparatus and for controlling the four lifting devices for co-action in a desired mode. It will be seen from what has now been said that unloading or loading from a load vehicle is a complicated and timeconsuming procedure.

Several drawbacks in known devices are removed with the aid of the invention and simple and effective handling is provided by the distinguishing features disclosed in the accompanying claims.

Figure 1:
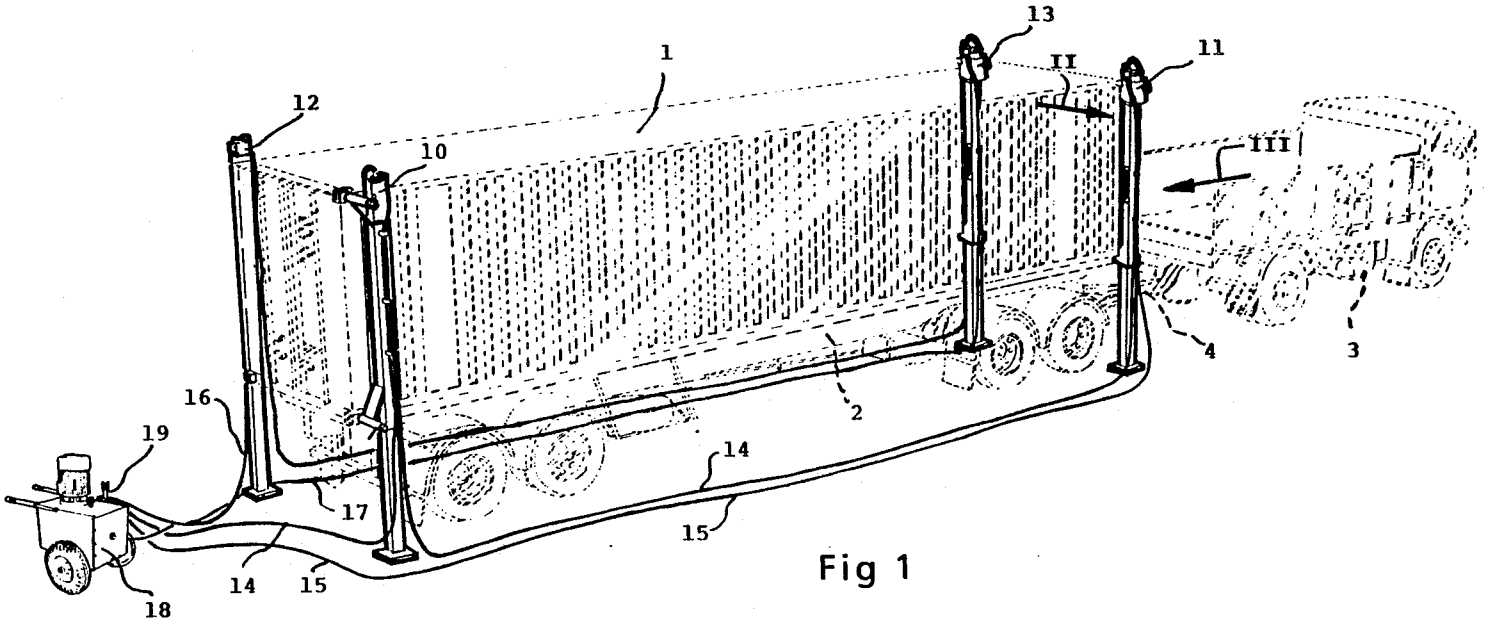
Figure 2:
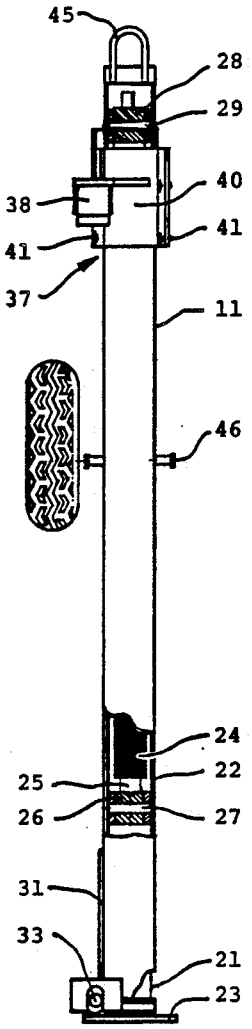
Figure 3:
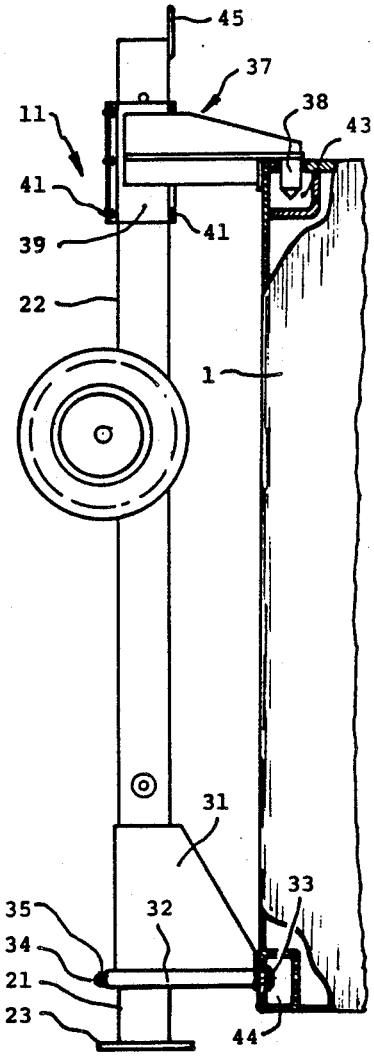
Figure 4:
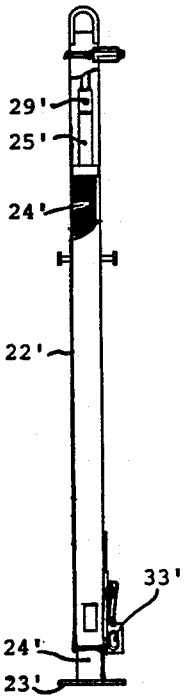
Figure 5:
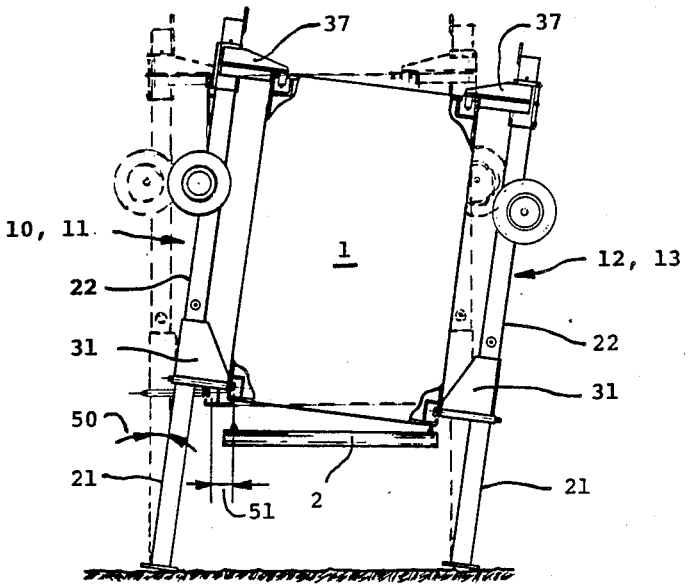
Figure 6:
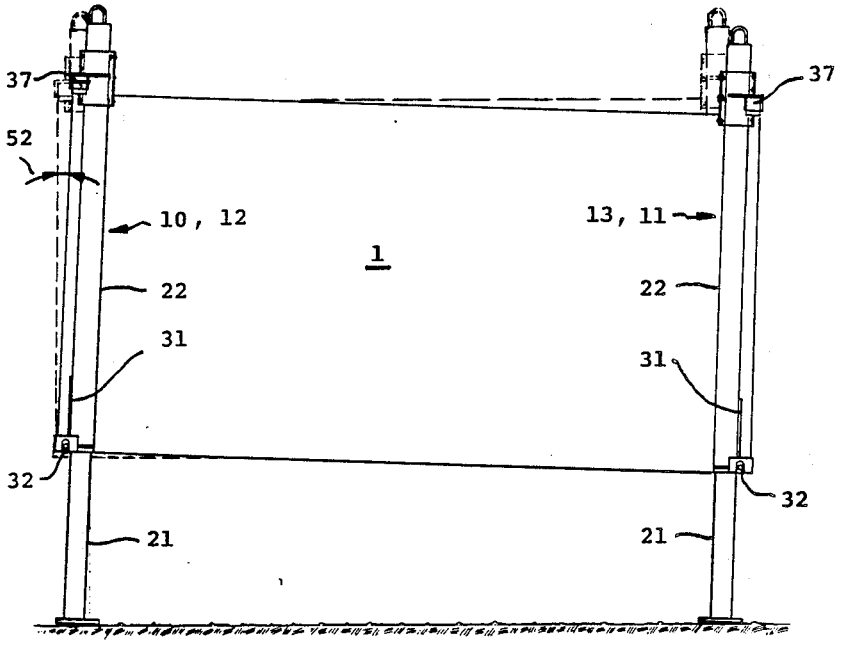
Figure 7:
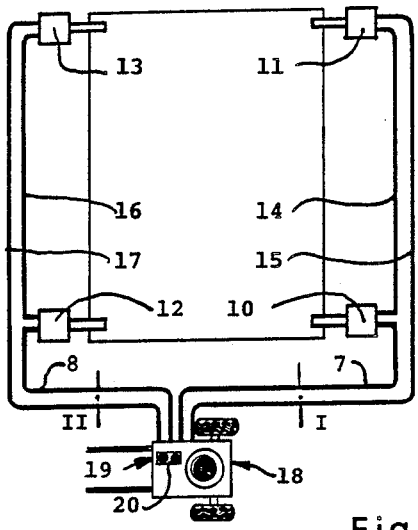
Figure 8:
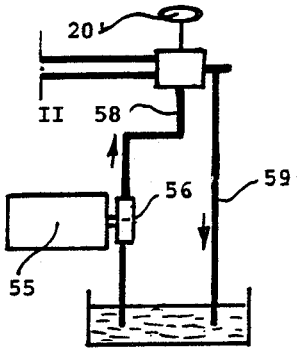
Figure 9:
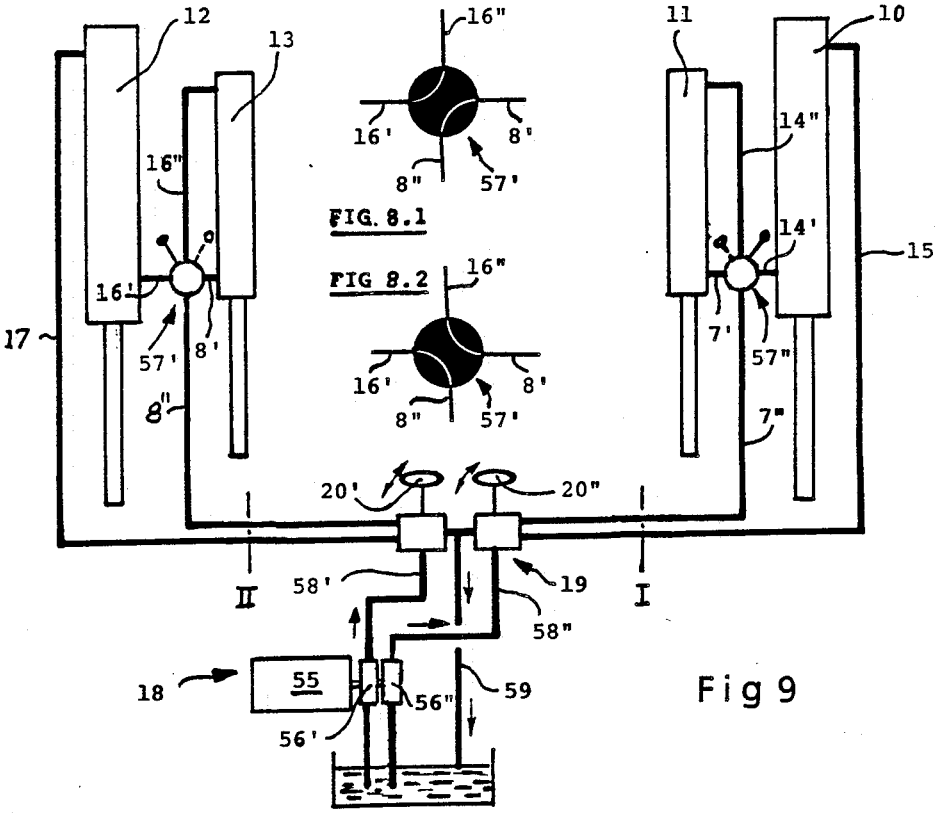
Figure 10:
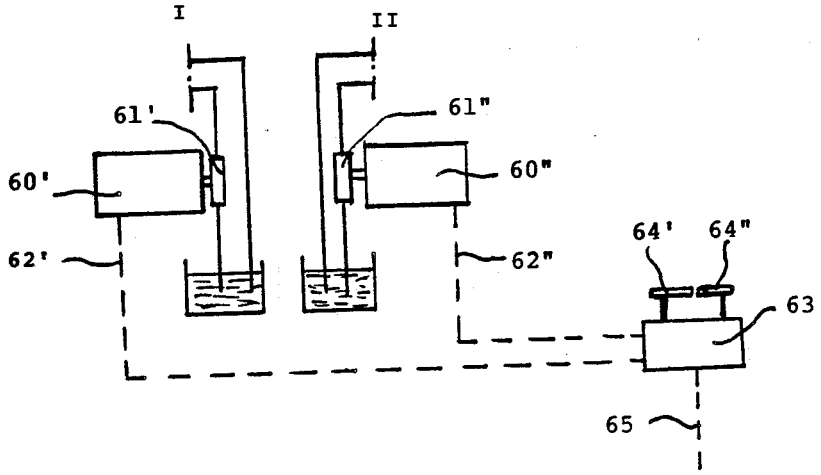
Figure 11:
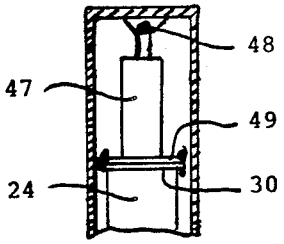
Figure 12:
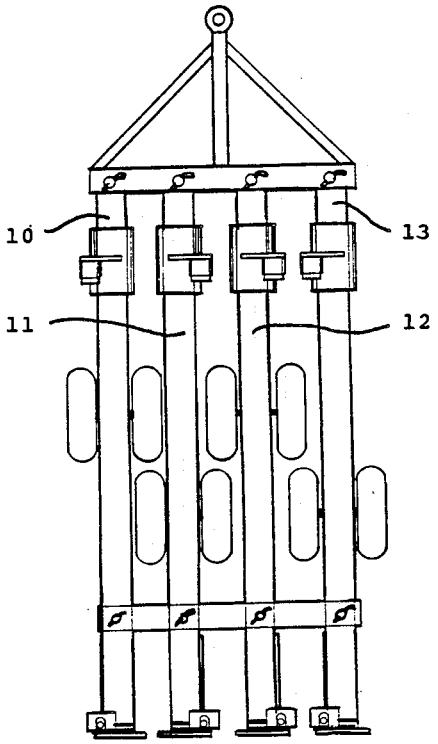
Figure 13:
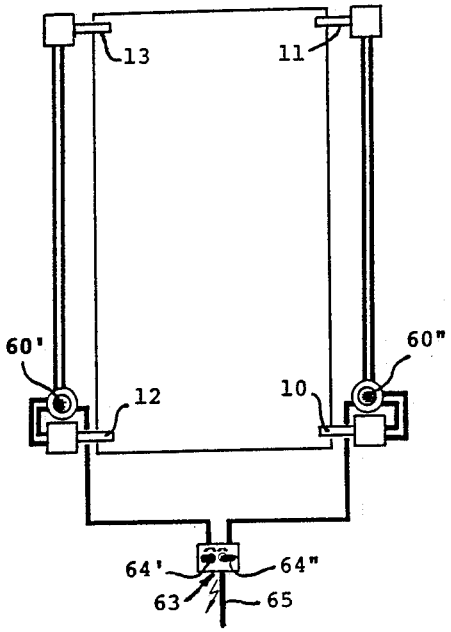
Figure 14:
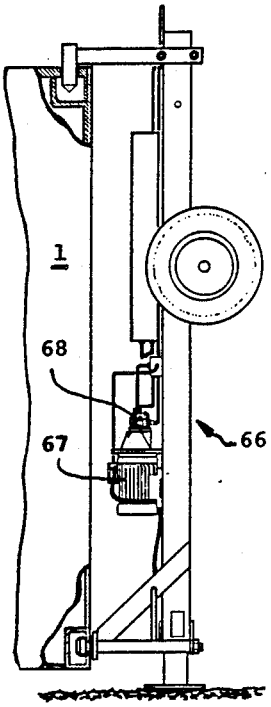
Figure 15:
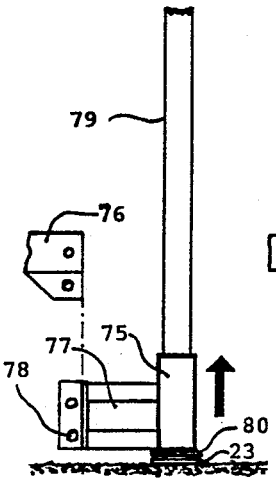
Figure 16:
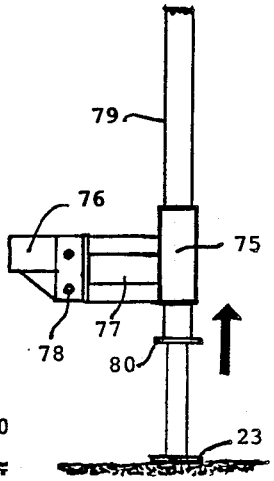
Figure 17:
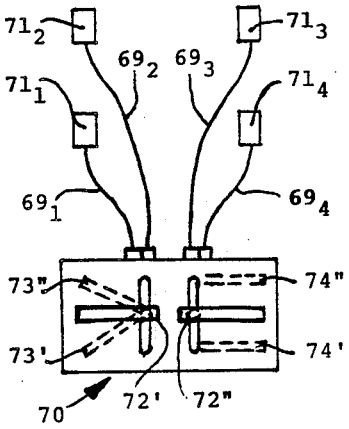

The invention will now be described in more detail with reference to the accompanying drawings, where FIG. 1 is a perspective view of a vehicle and a lifting device in accordance with the invention, FIG. 2 is a lifting column in side view in the direction II in FIG. 1, FIG. 3 the lifting column seen in the direction III in FIG. 1 and a part of the adjacent corner and corner boxes of the container, FIG. 4 is, lifting column of simple implementation, FIG. 5 is an end wall view of the container and lifting column, FIG. 6 is a side view of the container and lifting column, FIG. 7 illustrates a schematic hydraulic system with four lifting columns, hydraulic unit and control means for operation, FIG. 8 illustrates an alternative embodiment of the hydraulic system, FIG. 9 illustrates a modified embodiment of the system in FIG. 8, FIG. 10 illustrates a further embodiment of the system, FIG. 11 illustrates an adjusting cylinder built into a lifting column, FIG. 12 illustrates an apparatus for transporting all the four lifting columns included in the container lifting apparatus, FIG. 13 illustrates a lifting apparatus with lifting columns and control means, as well as connecting lines therebetween, FIG. 14 illustrates a lifting column with a hydraulic unit mounted thereon, which is driven by an electric motor, FIG. 15 illustrates a lifting column with an attachment means displaceable along it for containers, load decks or exchangeable decks for vehicles, FIG. 16 illustrates the position where the attachment is connected to a deck, and FIG. 17 illustrates control means with controls, drive units in the four lifting columns and connecting lines between all components.

In FIG. 1 the numeral 1 denotes a container which is placed on a trailer 2, towed by a truck 3 with the aid of a towing means 4 between truck and trailer.

Lifting columns are applied in pairs at the four corners of the container, columns 10 and 11 on the right hand side of the container at its rearward and forward corners respectively, while columns 12 and 13 are placed in a corresponding way on the other side of the container at its rearward and forward corners. The columns are each coupled to the upper and lower corner boxes of the container at the respective corner with the aid of a removable coupling means.

In the embodiment illustrated in the Figure the lifting columns are hydraulically driven. The hydraulic lines 14 and 15 connect the lifting columns 10 and 11 to a control means 19 on an electrically driven hydraulic unit 18. The lifting columns 12 and 13 are connected to the control means 19 by hydraulic lines 16 and 17 in the same way. The control means 19 controls the oil flow in the lines 14, 15 and 16, 17 to the hydraulic cylinders which are built into the lifting columns 10–13, the columns thus being given a telescoping movement by the cylinders, as described in more detail below.

It will be seen from FIGS. 2 and 3 that the lifting column comprises an inner tube 21 with a footplate 23, there being glidably arranged an outer tube 22 around the inner tube. A hydraulic cylinder 24 with a piston rod 25 is arranged inside the inner tube. A piston rod head 26 is disposed at the outer end of the piston rod 25. A piston head bolt 27 passes through the head 26 and is fastened to the inner tube 21. At the other end of the cylinder 24 there is a cylinder end 28 through which a cylinder bolt 29 passes. The cylinder bolt 29 is rigidly attached to the uppermost end of the outer tube 22. When the piston rod 25, illustrated in FIG. 2 in its inmost position, is thrust outwards from the cylinder, the upper end of the cylinder will be moved upwards together with the outer tube 22, which telescopically glides on the inner tube 21.

At its upper and lower ends the outer tube has attachments for connecting to the corner boxes of the container. The lower attachment 31 comprises a bracket carrying a sleeve 32 through which a twistlock 34 passes. The elongate, transverse head 33 of twistlock 34 is situated on the right hand end in FIG. 3 of the bolt and is intended to be conventionally inserted into the side opening of the lower corner box of the container, and after turning 90° to be locked in the box by tightening a nut 34 on the other end of the bolt in a conventional manner.

At its upper end the outer tube 22 has an upper attachment 37 projecting out from the tube in the same direction as the lower attachment 31. There is a locating pin 38 at the outer end of the upper attachment 37, this pin being adapted for insertion into the top opening of the upper corner box. In the illustrated embodiment, the upper attachment 37 is rigidly attached to a fitting 39, which surround one half of the outer tube 22. The fitting 39 is connected to a clamp 40 which surrounds the other half of the outer tube 22. The fitting 39 and clamp 40 each have two outwardly directed flanges, these flanges being pulled together with a bolted joint 41. The upper attachment 37 is thus movable in height along the outer tube 22 to a desired position, in which the attachment 37 can be locked with the aid of the bolted joints 41.

When a lifting column has been placed in position at one of the corners of the container, the whole column is lifted up such that the locating pin 38 can be inserted through the top hole in the upper corner box. The lifting column is then suspended by the bracket 37, and the lower attachment 31 can be swung so that the twistlock head 33 is brought into a position where the head can be inserted in the side hole of the lower corner box 44, and be turned 90° for being tightened down in the manner described above. The lifting column is thus attached to the corner of the container in this manner. When all four lifting columns 10–13 have been mounted at the corners in a corresponding way, the apparatus is ready for lifting the container.

For lifting the lifting column into position so that the locating pin 38 can be inserted in the top hole of the upper corner box 43 the column is provided with a stirrup 45 for a suitable lifting means. The columns can also be suitably provided with two opposing lifting studs 46. The studs are suitably adapted for co-action with a lifting fork which engages on both sides of the column, which is then easy to handle if the pins 46 are disposed close to the centre of gravity of the column.

FIG. 3 thus illustrates the container 1 with the corner boxes 43 and 44, as well as means 38 and 33 engaging in the corner boxes in a manner previously described.

An alternative embodiment of the lifting column is indicated in FIGS. 2 and 3, this embodiment being suitable for easy handling of the column, the weight of which can reach about 300 kg. The column is provided with two wheels arranged on a common shaft, these wheels being arranged in the vicinity of the centre of gravity of the column. Depending on the nature of the ground, it is easy for one or two persons to move the column on the ground up to the container which is to be lifted. Using a simple lifting means attached to the upper corner box 43 of the container 1 in this case, the column can be lifted up so that the locating pin 38 can be inserted in the top hole of the upper corner box in a way that has been described previously. In comparison with the lifting column in FIG. 2 the column in FIG. 4 has a more simple structure, which comprises an outer tube 22' inside which the casing of the hydraulic cylinder 24' itself can be moved telescopically with a good fit. The cylinder casing is at the bottom part of the tube 22' and is provided with a footplate 23' directly on the end wall of the casing. At the upper end the piston rod 25' of the hydraulic cylinder 24' is provided with a bolt 29' connected to the telescope tube 22'. By the structure illustrated in the Figure it has also been possible to avoid one of the telescopic tubes and thus reduce weight considerably.

FIG. 5 illustrates the container seen from one end e.g. from the rear, and the load deck of a transporter under the container. Dashed lines have been used to illustrate the position of the container when the lifting columns are vertical. In the illustrated position the transporter has not been able to be placed exactly right so that the locating pins on the transporter could register directly with the lower holes of the corner boxes. In accordance with the invention, the right hand pair of lifting columns 10, 11 can be activated by the control means 19 independently of the left hand pair 12, 13 and vice versa. It is thus possible, as illustrated by the full lines in the Figure, to move the container a given distance 51 transversely by one pair of columns 10, 11 being telescoped out further than the other pair 12, 13. This results in a transverse displacement 51 of the container so that the holes in the bottom corner boxes of the container can be brought into register with the locating pins on the vehicle so that the container can be lowered with its corner holes in register with the locating pins. By the availability of this property it will be very easy to lift up the container from the ground, drive the transport vehicle under it and put down the container in the right position on the vehicle without the vehicle needing to be driven backwards and forwards to get the corner box holes in register with the locating pins when conditions are difficult, e.g. due to an irregular substructure.

In order to provide a slope of the container longitudinally, using different telescoping of the lifting columns, one or more columns are provided with double cylinders in a special embodiment in accordance with the invention, where a small shifting ram with a relatively short stroke is placed in line with the hydraulic cylinder 24 of the column, as will be described later.

An embodiment of the invention is illustrated in FIG. 6 where the container can be longitudinally inclined by an angle 52. This inclination can take place such that both columns at one end wall, e.g. the columns 10 and 12 are telescoped equally as much. If the ground is sloping the cylinders can be telescoped different amounts to bring the container horizontal. This will be described in conjunction with FIG. 11 below.

The hydraulic driving system is schematically illustrated in FIG. 7, where 18 denotes the hydraulic power unit with control means 19. Controls 20', 20'' denoted generally at 20 are provided for activating suitable valves n the control means 19. The lifting columns are connected in pairs on each side by hydraulic lines. Accordingly, the lifting cylinders of the right hand pair 10, 11 are connected to each other in series by the hydraulic lines 7-14-15 and the cylinders of the left hand pair 12, 13 are connected to each other in series by the hydraulic lines 8-16-17. By connecting the lifting cylinders (hydraulic cylinders 24) in this way there is achieved that both hydraulic cylinders in a pair of lifting columns move synchronously. This is conventional technique, which is sometimes known as "master and slave" coupling since the movement of one cylinder follows and is controlled by the other cylinder.

With the aid of the described arrangement, the side of the container carried by a pair of lifting columns will move in parallel in the vertical direction. The same applies to the side carried by the other pair of lifting columns. By control from the control means 19 with the aid of the controls 20 both pairs of lifting columns 10, 11 and 12, 13 can be caused to move synchronously so that the whole container is moved in parallel vertically. By solely activating one pair of lifting columns, e.g. 10 and 11, the effect illustrated in FIG. 5 is obtained.

FIG. 8 is a hydraulic circuit diagram shown in somewhat more detail. The Figure illustrates the two pairs of lifting columns 12, 13 and 10, 11. The hydraulic circuit, which in FIG. 7 includes the parts denoted by 8,12, 16, 13, 17, is corresponded to in FIG. 8 by 8'', 8', 13, 16'', 16', 12 and 17. For an oil flow to take place through the components in the mentioned order, a reversing valve 57' disposed between the cylinders 12 and 13 assumes the position illustrated in FIG. 8.1. When the valve 57' assumes the position illustrated in FIG. 8.1 both lifting columns 12, 13 will accordingly execute synchronous movements. If the valve 57' is set according to FIG. 8.2 by turning the valve body 90°, the connection lines 16'' and 8'' of the lifting column 13 will be connected to each other so that the lifting column 13 is disconnected from the rest of the hydraulic system and is "short-circuited", whereby the piston in the cylinder associated with the lifting column 13 cannot move. Simultaneously as this takes place there is formed a circuit of the components 8'', 16', 12 and 17. This signifies that the oil flow can be controlled solely through the cylinder of the lifting column 12, the piston of this cylinder and thereby the lifting column thus being enabled to be given a length which is greater or less than the length of the cylinder placed in the lifting column 13.

The hydraulic flow through the mentioned circuits is controlled by the control 20' which is connected by a pressure line 52' to a hydraulic pump 56' which is driven by a motor 55. The hydraulic system has a return line 59. The motor 55 also drives a hydraulic pump 56'' which is identical to the pump 56' and is arranged on the same shaft. The hydraulic pressure is taken via the line 58'' to the control 20'', which also utilizes the common return line 59. The components 7'', 57'', 7', 11, 14'', 14', 10 and 15 are identical with those described previously in conjunction with the left hand lifting columns in the Figure. It is thus obvious that the lifting column 11 can be "short-circuited" while the lifting column 10 is adjusted to the desired position in relation to the short-circuited lifting column.

From what has been described above it will be understood that all the lifting columns 10, 11, 12 and 13 can be set in different positions in relation to each other. When this has taken place, and the reversing valves 57',57'' have been set in their positions corresponding to that in FIG. 8.1 all four lifting columns can be given a synchronous movement by moving both controls 20' and 20'' in identically the same way. This is easy to do, since the controls are close to each other and can be adjusted with the aid of one hand in the same way as the throttle controls in an aircraft, for example.

FIG. 9 illustrates an alternative embodiment of the drive unit and control means. The illustrated apparatus comprises a motor 55 and a single pump 56, supply line 58 and return line 59 and the control 20' and 20'', which function in the same way as described above in connection with FIG. 8. The apparatus in FIG. 9 is an alternative to the portion in FIG. 8 which is bounded by the chain dotted lines I and II. The motor 55, which drives the hydraulic pump or pumps can be an electric motor, an internal combustion engine or some other power source.

FIG. 10 illustrates a further alternative arrangement I-II, intended for electrical operation and therefore suitable when electric 3-phase current is available. Hydraulic pumps 61, 61'' are each driven by a 3-phase motor 60' and 60'', supplied by 3-phase lines 62' and 62'', which are connected to a control means 63 with controls 64' and 64'' for the respective motors 60' and 60''. A 3-phase mains supply is denoted by 65.

With the apparatus in FIG. 10, the pair of lifting columns 12, 13 can be operated by the components denoted by ' while the other pair of lifting columns 10, 11 can be operated by the components denoted by ''.

The 3-phase motors 60' and 60'' can be driven in parallel with the aid of the control means 63. Due to the equal load, the rpm will be very similar. Synchronous motors can also be used.

The identical pumps 61' and 61'' will then give equally as great flows and all the cylinders will be given a synchronous movement. The apparatus illustrated in FIG. 10 gives the designer greater freedom to connect the different components in the container lifting system by having certain hydraulic supply and return lines replaced with a lighter electric cable.

FIG. 11 schematically illustrates an apparatus with the aid of which the effect illustrated in FIG. 6 can be achieved. With this in mind the cylinder end 28 of the hydraulic cylinder 24 has been exchanged for an end portion provided with a flange 30. A bolted joint connects the flange 30 with a flange 49 which in a similar way is fastened to the end of an adjusting cylinder 47. The ram of the adjusting cylinder thrusts out from the cylinder in the opposite direction to the piston rod 25 of the hydraulic cylinder 24. The ram of the cylinder 47 is connected at one end to a cylinder bolt 48 which, as with the previously described cylinder bolt 29, is connected to the outer tube of the lifting column.

An adjustment cylinder 47 can be arranged in an optional number of lifting columns. The adjusting cylinders are arranged for control directly from the control means 19 and by separate controls. By solely activating both adjusting cylinders at one end wall of the container the effect illustrated in FIG. 6 can be obtained. By actuating the adjusting cylinders individually the container can be given a horizontal position without needing to actuate the lifting cylinders. It should also be emphasized that when the adjusting cylinders 47 are not in action, the force from the bolt 48 is transferred mechanically to the flange 30 of the hydraulic cylinder 24 by the piston engaging against the bottom of the cylinder 47.

An embodiment of the lifting columns is illustrated in FIG. 12 which enables transporting the columns on the ground behind a towing vehicle, e.g. a tractor. The columns are here provided with connections for a coupling means for a towing bar so that they can be removably connected to each other. If so desired, the hydraulic power unit can also accompany the columns by arranging suitable fastenings.

FIG. 13 schematically illustrates the complete lifting system in which the components illustrated in FIG. 10 are included. The electrohydraulic units are placed on the lifting columns 10 and 12.

FIG. 14 illustrates an embodiment of one of four like electrohydraulic lifting columns 66. Each lifting column is provided with a small electric motor 67, which may be a 3-phase motor or a synchronous motor depending on the requirements placed on synchronous movement. The motor drives a small hydraulic pump 68 for supplying power to the hydraulic cylinder of the lifting column. In this embodiment the lifting columns are connected to each other and to a control means solely by electrical lines connected by junction means. Great freedom is obtained in the design of the apparatus simultaneously as no hydraulic connections are required, which makes handling clean and convenient.

The control means is controlled such as illustrated in FIG. 17. Four electrical lines $69_1$, $69_2$, $69_3$ and $69_4$ connect the control means 70 to each of the electric motors $71_1$, $71_2$, $71_3$ and $71_4$. The electrical lines $69_1$ and $69_2$ are connected to the motors $71_1$ and $71_2$ on one long side of the container and to the left hand control 72', and in the same way the lines $69_3$ and $69_4$ for the motors $71_3$ and $71_4$ of the other long side are connected to the right hand control 72" in the Figure. Each control 72' and 72" can be rotated round its inner end such as illustrated for the left hand control 72', between the end positions 73' and 73", while the control can be moved forwards and backwards without rotation as illustrated for the right hand control 72", and between the end positions 74' and 74". For rotation of a control one or other of the motors for the lifting columns of one side are actuated, e.g. so that turning towards 73' actuates the motor $71_1$ and turning towards 73" actuates the motor $71_2$. The effect illustrated in FIG. 6 may be achieved by turning both controls 72' and 72".

If a control is moved linearly, both motors for the lifting columns on one side are actuated, e.g. such that the movement towards 74' actuates both motors $71_3$ and $71_4$ so that the lifting columns are extended synchronously, and movement towards 74" actuates the motors $71_3$ and $71_4$ so that the lifting columns are retracted synchronously, see FIG. 5.

It will be understood from what has been said that if the operator has one hand over both controls 72' and 72" and moves them simultaneously all the lifting columns will change their lengths synchronously.

FIG. 15 illustrates an embodiment of a lifting column intended for lifting a load deck 76. In the Figure, the numeral 75 denotes a sleeve which can be displaced along the outer tube 79 of the lifting column. The sleeve has a bracket 77 with attachment means 78 at its outer end.

In FIG. 16 it is illustrated how the unit 75-77-78 has been lifted up by hand to the load deck 76 and attached thereto along both sides close to the corner. When the lifting column is actuated for lifting, the outer tube 79 moves upwards while gliding in the sleeve 75 until a stop 80 arranged on the lower end of the outer tube comes into contact with the sleeve 75 and thereafter lifts the load or exchange deck 76 upwards. This can take place in a manner described above and it is also obvious that a lifting column according to FIG. 15 and 16 can be used for a container.

One skilled in the art can achieve other embodiments within the scope of the invention as described in the accompanying claims. For example, it is possible to replace the hydraulic cylinders with a completely mechanical means which may comprise an electric motor driving a translation means in the form of a ball nut screw or the like.

I claim:

1. Arrangement in a lifting system for a container, including four lifting columns, each adapted for being removably connected to one of the four vertical corner edges of the container, each lifting column being telescopable with the aid of a power means, driven by a power source under the actuation of a control means with controls, said lifting columns being in pairs, respectively, included in two separate lifting aggregates placed at opposite sides of the container, and the power means for said pairs of columns being arranged and interconnected such that they achieve a simultaneous displacement of the two pairs of lifting columns of the/each lifting aggregate, the improvement wherein:

each lifting aggregate comprises a closed loop circulation circuit, including in order, a connecting piping (7;8) from the controls (20';20") of the control means (19) to the first lifting column (10;12) of a pair of lifting columns, a first interconnection (14;16) from the first lifting column (10;12) to the second lifting column (11;13) of a lifting aggregate and a second interconnection (15;17) from said second lifting column (11;13) back to the control means (19), thereby defining a first closed loop (20"-7-10-14-11-15-20") at one side of the container (1) completely separated from a second closed loop (20'-8-12-16-13-17-20') at the other side of the container for effecting synchronous and equal displacement of said lifting column pairs for each of said two separate lifting aggregates.

2. Arrangement as claimed in claim 1, characterized in that the power means of the lifting columns comprise hydraulic cylinders (24, 24'), connected in series and adapted to a so-called "master and slave" system to achieve the synchronous telescoping of the lifting columns.

3. Arrangement as claimed in claim 2, characterized in that the connection means (16', 16") between the two hydralic cylinders of the lifting columns (12, 13) of a lifting aggregate have a valve means (57'), which is settable between two positions such that the valve means in the first position provides said series "master and slave" connection of the cylinders for synchronous movement, while said means (57') in a second position (FIG. 8.2) closes the connection (16") to the cylinder of one lifting column (13) so that this cylinder is blocked in a locked position and solely the cylinder of the second lifting column (12) remains in the hydraulic circuit (20'-17-12-16'-57'-8"-20'), for the purpose of allowing movement of said second cylinder of the other lifting column (12) relative the blocked cylinder (13) of the lifting column (13).

4. Arrangement as claimed in claim 3, characterized in that the connections (16', 8") of the cylinder in one lifting column (13) are connected to each other so that this cylinder is short circuited.

5. Arrangement as claimed in claim 1, characterized in that the outer telescoping part of the lifting column comprises a tube (22') while the inner telescoping part of the column comprises the cylindrical casing (24') of the hydraulic cylinder itself.

6. Arrangement as claimed in claim 1, characterized in that each lifting aggregate comprises an electrohydraulic power source (60', 61'; 60", 61") placed on one of the two lifting columns included in the aggregate, in that connection lines between the two lifting columns of the aggregate comprises hydraulic lines, while the connection lines between the lifting aggregate and control means (63) comprise electrical lines (62', 62").

7. Arrangement as claimed in claim 2, characterized in that a hydraulic cylinder (24) is rigidly connected at its piston chamber end to the piston chamber end of an adjusting cylinder (47), which is intended for displacing the hydraulic cylinder and thereby changing the length of the lifting column in question.

8. Arrangement as claimed in claim 1, characterized in that the outer telescoping part (79) of the lifting column carries a sleeve (75) displaceable along this part, the sleeve being provided with a bracket (77) and attachment means (78) for removable connection of the bracket to a load deck (76) or a corner of a container, and in that the outer telescoping part has at its lower end a stop (80), which when the lifting column is telescoped is urged into engagement against a sleeve (75) and thereafter lifts upwards the sleeve (75), bracket (77), attachment means (78) and load deck (76) with load.

9. Arrangement as claimed in claim 1, characterized in that the control means (70) has two controls (72', 72''), each being adapted for forwards and backwards movement (74'-74'') and rotational movement (73', 73'') a rotation (73', 73'') actuating the pair of lifting columns ($71_1$, $71_2$; $71_3$, $71_4$) connected to the control such that only one lifting column in the pair changes its length, while a linear movement (74', 74'') causes both lifting columns to change their lengths synchronously.

* * * * *